US009568187B2

(12) United States Patent
Miura

(10) Patent No.: US 9,568,187 B2
(45) Date of Patent: Feb. 14, 2017

(54) CONTROL PROGRAM, CONTROLLER, AND BOILER SYSTEM

(75) Inventor: Koji Miura, Matsuyama (JP)

(73) Assignee: MIURA CO., LTD., Matsuyama-Shi, Ehime-Ken (JP)

( * ) Notice: Subject to any disclaimer, the term of this patent is extended or adjusted under 35 U.S.C. 154(b) by 1045 days.

(21) Appl. No.: 13/060,601

(22) PCT Filed: Apr. 24, 2009

(86) PCT No.: PCT/JP2009/058188

§ 371 (c)(1),
(2), (4) Date: Feb. 24, 2011

(87) PCT Pub. No.: WO2010/023994

PCT Pub. Date: Mar. 4, 2010

(65) Prior Publication Data

US 2011/0162593 A1 Jul. 7, 2011

(30) Foreign Application Priority Data

Aug. 25, 2008 (JP) ..... 2008-215676

(51) Int. Cl.

| | |
|---|---|
| ***F22D 5/00*** | (2006.01) |
| ***G05B 21/00*** | (2006.01) |
| ***F22B 35/00*** | (2006.01) |
| ***F23N 1/08*** | (2006.01) |
| ***F23N 5/02*** | (2006.01) |
| ***F24H 1/22*** | (2006.01) |
| ***F23N 5/00*** | (2006.01) |
| ***F22B 33/00*** | (2006.01) |

(52) U.S. Cl.
CPC ..... *F22B 35/00* (2013.01); *F22B 33/00* (2013.01)

(58) Field of Classification Search
USPC ..... 122/448.3; 702/182
See application file for complete search history.

(56) References Cited

U.S. PATENT DOCUMENTS

| | | | | |
|---|---|---|---|---|
| 3,387,589 | A * | 6/1968 | Chan et al. | 122/1 R |
| 3,877,867 | A * | 4/1975 | Tsuchiya et al. | 432/45 |
| 4,337,893 | A * | 7/1982 | Flanders et al. | 237/7 |
| 4,418,541 | A * | 12/1983 | Russell | 60/667 |
| 4,482,814 | A * | 11/1984 | Daniels | 290/40 B |

(Continued)

FOREIGN PATENT DOCUMENTS

| | | |
|---|---|---|
| JP | 3-110304 | 5/1991 |
| JP | 6-147402 | 5/1994 |

(Continued)

*Primary Examiner* — Gregory Huson
*Assistant Examiner* — Eric Gorman
(74) *Attorney, Agent, or Firm* — Muncy, Geissler, Olds & Lowe, P.C.

(57) ABSTRACT

A storage medium stores a control program including program code for, in the case of increasing a quantity of combustion in the boiler group, after a high-efficiency combustion shift signal that makes the shift to the high-efficiency combustion position is output to all of the boilers subject to high-efficiency control by which control is conducted on the basis of combustion at the high-efficiency combustion position, outputting a control signal that makes the shift to a higher combustion position than the high-efficiency combustion positions for any one of the high-efficiency control subject boilers.

9 Claims, 5 Drawing Sheets

(56) References Cited

U.S. PATENT DOCUMENTS 4,498,861 A * 2/1985 Suzuki et al. ..... 431/12
4,534,321 A * 8/1985 Rydborn ..... 122/448.3
4,622,922 A * 11/1986 Miyagaki et al. ..... 122/449
4,860,696 A * 8/1989 Fujita ..... 122/448.3
4,864,972 A * 9/1989 Batey et al. ..... 122/448.3
5,172,654 A * 12/1992 Christiansen ..... 122/448.3
5,203,159 A * 4/1993 Koizumi et al. ..... 60/773
5,259,342 A * 11/1993 Brady et al. ..... 122/367.1
5,433,174 A * 7/1995 Brady et al. ..... 122/367.1
5,522,348 A * 6/1996 Tanaka et al. ..... 122/367.1
5,626,104 A * 5/1997 Tanaka et al. ..... 122/367.1
5,638,773 A * 6/1997 Brady et al. ..... 122/248
5,665,710 A * 9/1997 Rahman et al. ..... 514/44 A
5,764,535 A * 6/1998 Okazaki et al. ..... 700/274
6,560,563 B1 * 5/2003 Lang ..... 702/182
6,584,429 B1 * 6/2003 Lang ..... 702/182
6,647,302 B2 * 11/2003 Pouchak ..... 700/83
6,823,290 B2 * 11/2004 Sakamoto et al. ..... 702/188
7,484,955 B2 * 2/2009 Flynn et al. ..... 431/9
7,819,334 B2 * 10/2010 Pouchak et al. ..... 237/8 R
2002/0065685 A1 * 5/2002 Sasaki et al. ..... 705/3
2004/0176858 A1 * 9/2004 Kuwahara ..... G05B 15/02 700/9
2004/0185399 A1 * 9/2004 Moberg ..... 431/4
2004/0231332 A1 * 11/2004 Saucedo et al. ..... 60/671
2005/0230490 A1 * 10/2005 Pouchak et al. ..... 237/81
2005/0230491 A1 * 10/2005 Pouchak et al. ..... 237/81
2007/0223705 A1 * 9/2007 Kasahara et al. ..... 380/281
2007/0260490 A1 * 11/2007 Sasaki et al. ..... 705/2
2008/0050684 A1 * 2/2008 Flynn et al. ..... 431/12
2009/0132095 A1 * 5/2009 Sekiai et al. ..... 700/286
2009/0223466 A1 * 9/2009 Knorr, Jr. ..... 122/448.1
2010/0083883 A1 * 4/2010 Hofer et al. ..... 110/234
2011/0162593 A1 * 7/2011 Miura ..... 122/448.1
2011/0238216 A1 * 9/2011 Yamada et al. ..... 700/274
2011/0303163 A1 * 12/2011 Ookubo et al. ..... 122/14.22
2012/0006285 A1 * 1/2012 Miura et al. ..... 122/448.3
2015/0184548 A1 * 7/2015 Yamada ..... F22B 35/008 60/667
2015/0204537 A1 * 7/2015 Yamada ..... F22B 35/00 122/448.1
2015/0267914 A1 * 9/2015 Yamada ..... F22B 35/008 122/448.3
2016/0201895 A1 * 7/2016 Hyodo ..... F22B 35/008 122/448.3

FOREIGN PATENT DOCUMENTS

JP 11-132405 5/1999
JP 2002-81606 3/2002
JP 2002-130602 5/2002
JP 2005043001 A * 2/2005 ..... F22B 35/00
JP 2008-170114 7/2008

* cited by examiner

PSN- priority sequence number
CP-combustion position i - priority order of a boiler
j - combustion position of a boiler

CONTROL PROGRAM, CONTROLLER, AND BOILER SYSTEM

INCORPORATION BY REFERENCE

This application is a 371 of International Application No. PCT/JP2009/058188 filed Apr. 24, 2009, which claims priority to Japanese Patent Application No. 2008-215676 filed Aug. 25, 2008, the entire contents of which being hereby incorporated herein by reference.

BACKGROUND OF THE INVENTION

1. Field of the Invention

The present invention relates to a control program, a controller, and a boiler system that are related to a boiler group including a plurality of boilers controlled in combustion at stepwise combustion positions.

2. Description of the Related Art

Conventionally, in the case of bringing a steam pressure or a hot water temperature close to a target value through combustion in a boiler group including a plurality of boilers, control has been conducted widely on the boilers by calculating the number of combustion-subject boilers and their combustion positions based on an increase/decrease in desired load, technologies on which combustion control are disclosed (see, for example, Japanese Patent Application Laid-Open Publication No. 2002-130602).

Further, as technologies for improving combustion efficiency and steam productivity are disclosed, those on the boilers capable of low combustion, intermediate combustion, and high combustion are disclosed (see, for example, Japanese Patent Application Laid-Open Publication No. 6-147402).

However, in the case of combustion control on a boiler group including a plurality of boilers capable of low combustion and high combustion, if the combustion efficiency during low combustion is higher than that during high combustion, high-efficiency operations can be performed by increasing the number of the combustion-subject boilers based on the low combustion; however, in the case of combustion control based on low combustion, the number of the boilers is decreased as the desired loads decrease, so that start-and-stop losses are liable to occur.

On the other hand, if the combustion efficiency during high combustion is higher than that during low combustion, high-efficiency operations can be performed by increasing the number of the combustion-subject boilers based on the high combustion; however, in the case of combustion control based on high combustion, if the desired loads increase, it is necessary to newly start combustion in the standby boilers, so that the desired load follow-up performance deteriorates due to a delay in response.

Taking into account such a situation, there are technological demands for improving both the combustion efficiency and the desired load follow-up performance in combustion control on a boiler group including a plurality of installed boilers in which combustion is performed at a plurality of stepwise combustion positions.

SUMMARY OF THE INVENTION

In view of the above, the present invention has been developed, and it is an object of the present invention to provide a control program, a controller, and a boiler system that are related to combustion control on a boiler group including a plurality of boilers having stepwise combustion positions and that can inhibit start-and-stop losses and improve follow-up performance while keeping a high combustion efficiency.

To solve those problems, the present invention provides the following means.

In accordance with a first aspect of the present invention, there is provided a control program for conducting control on a boiler system that includes a boiler group including a plurality of boilers which can be controlled in combustion quantity at stepwise combustion positions and in which at least one of the combustion positions is assumed to be a high-efficiency combustion position having a higher combustion efficiency than the other combustion positions and that is configured to be controlled in combustion based on an increase/decrease in desired loads, wherein in the case of increasing a quantity of combustion in the boiler group, after a high-efficiency combustion shift signal that makes the shift to the high-efficiency combustion position is output to all of the boilers subject to high-efficiency control by which control is conducted on the basis of combustion at the high-efficiency combustion position, a control signal is output that makes the shift to a higher combustion position than the high-efficiency combustion positions for any one of the high-efficiency control subject boilers.

In accordance with another aspect of the present invention, there is provided a controller includes the above control program.

In accordance with still another aspect of the present invention, there is provided a boiler system includes the above controller.

In accordance with the control program, controller, and boiler system according to the present invention, when increasing a combustion quantity in the boiler group, after the high-efficiency combustion shift signal is output to all of the boilers subject to high-efficiency control, the control signal is output that makes the shift to the higher combustion position than the high-efficiency combustion positions for the high-efficiency control subject boiler. As a result, until the high-efficiency combustion shift signal is output to all of the high-efficiency control subject boilers, the control signal is not output that makes the shift to the higher combustion position than the high-efficiency combustion positions, so that combustion becomes easy to occur in the high-efficiency control subject boilers at the high-efficiency combustion position, thereby improving the combustion efficiency of the boiler group.

Further, after all the boilers are shifted to the high efficiency combustion position, no start-and-stop operations occur when increasing the combustion quantity, so that the start-and-stop losses are suppressed and the follow-up performance is improved.

In the above aspect, in the case of increasing the quantity of combustion in the boiler group, subsequently to the high-efficiency combustion shift signal output to all of the high-efficiency control subject boilers, a combustion start signal is output to any one of the boilers other than the high-efficiency control subject boilers and a control signal for increasing the combustion quantity is output to this boiler to reach a situation in which the high-efficiency combustion shift signal is output, and each time this high-efficiency combustion shift signal is output, the control signal that makes the shift to the higher combustion position than the high-efficiency combustion positions is output to any one of the high-efficiency control subject boilers.

In accordance with the control program according to the present invention, when increasing the quantity of combustion in the boiler group, after the high-efficiency combustion shift signal is output to all of the high-efficiency control subject boilers, the combustion start signal is output to any one of the boilers other than the high-efficiency control subject boilers to increase the combustion quantity, and each time the high-efficiency combustion shift signal is output to this boiler, the control signal that makes the shift to the higher combustion position is output to any one of the high-efficiency control subject boilers, so that in a case where all of the high-efficiency control subject boilers are controlled so as to undergo combustion at the high-efficiency combustion position, more of the combustion positions to which the shift is made are secured during a lapse of time from one boiler starts combustion until another one starts it, to inhibit the start-and-stop losses, thereby improving the follow-up performance.

In the above aspect, in the case of increasing the quantity of combustion in the boiler group, the high-efficiency control subject boilers to which the control signal that makes the shift to the combustion position higher than the high-efficiency combustion position is output is provided with the combustion quantity increasing control signal, so that each time a highest combustion position shift signal is output that makes the shift to a highest combustion position where the combustion quantity is maximized, subsequently the combustion start signal is output to any one of the boilers other than the high-efficiency control subject boilers that is yet to be provided with the combustion start signal.

In accordance with the control program according to the present invention, when increasing the quantity of combustion in the boiler group, if the control signal that makes the shift to the combustion position higher than the high-efficiency combustion position is output to anyone of the high-efficiency control subject boilers to increase the combustion quantity until the highest combustion position shift signal is output, the combustion start signal is output to anyone of the boilers other than the high-efficiency control subject boilers that is yet to start combustion, thereby inhibiting the start-and-stop losses and also improving the desired load follow-up performance. It is to be noted that in such control, it is well suitable that the signal may not be output to the boilers such as preliminary ones that are not subject to operations.

In accordance with yet another aspect of the present invention, there is provided a boiler system that includes a boiler group including a plurality of boilers which can be controlled in combustion quantity at stepwise combustion positions and in which at least one of the combustion positions is assumed to be a high-efficiency combustion position having a higher combustion efficiency than the other combustion positions and that is configured to be controlled in combustion based on an increase/decrease in desired loads, wherein in the case of increasing a quantity of combustion in the boiler group, after all of the boilers subject to high-efficiency control by which control is conducted on the basis of combustion at the high-efficiency combustion position have made the shift to the high-efficiency control position, any one of the high-efficiency control subject boilers is shifted to the combustion position higher than the high-efficiency combustion position.

In accordance with the boiler system according to the present invention, when increasing the quantity of combustion in the boiler group, after shifting all of the high-efficiency control subject boilers to the high-efficiency combustion position, the shift is made to the combustion position higher than the high-efficiency combustion position, so that it is necessary to generate high-efficiency combustion in the boiler group.

In the yet another aspect, in the case of increasing the quantity of combustion in the boiler group, subsequently to the shift of all of the high-efficiency control subject boilers to the high-efficiency combustion position, combustion starts in any one of the boilers other than the high-efficiency control subject boilers to increase the combustion quantity, so that each time this boiler reaches the high-efficiency combustion position, any one of the high-efficiency control subject boilers is shifted to the combustion position higher than the high-efficiency combustion position.

In accordance with the boiler system according to the present invention, when increasing the quantity of combustion in the boiler group, after all of the high-efficiency control subject boilers have shifted to the high-efficiency combustion position, combustion starts in anyone of the boilers other than the high-efficiency control subject boilers, so that each time this combustion-started boiler reaches the high-efficiency combustion position, any one of the high-efficiency control subject boilers has the higher combustion position, thereby inhibiting the start-and-stop losses and improve the desired load follow-up performance in a case where all of the high-efficiency control subject boilers are at the high-efficiency combustion position.

In the yet another aspect, in the case of increasing the quantity of combustion in the boiler group, each time the combustion quantity in the high-efficiency control subject boilers that have shifted to the combustion position higher than the high-efficiency combustion position increases up to a highest combustion position where the combustion quantity is maximized, combustion starts in any one of the boilers other than the high-efficiency control subject boilers that is yet to start combustion.

In accordance with the boiler system according to the present invention, when increasing the quantity of combustion in the boiler group, each time any one of the high-efficiency control subject boilers shifts to the highest combustion position so that those boilers may come short of a necessary combustion quantity at this highest combustion position, combustion starts in any one of the boilers other than the high-efficiency control subject boilers that is yet to start combustion, thereby inhibiting the start-and-stop losses and improve the desired load follow-up performance.

In the above aspect, the number of the high-efficiency control subject boilers can be set.

In the yet another aspect, the number of the high-efficiency control subject boilers can be set.

In accordance with the control program and the boiler system according to the present invention, for example, in a case where the desired loads change from day to day, combustion control is conducted so that the number of the high-efficiency control subject boilers may be set to an appropriate value that matches the day-to-day desired loads, thereby enabling improving the combustion efficiency.

In the yet another aspect, the boilers are four-position control boilers in which combustion can be controlled in a low combustion state, an intermediate combustion state, and a high combustion state; and wherein the combustion quantity in the intermediate combustion state is equal to or less than a half of the combustion quantity in the high combustion state, the combustion quantity in the low combustion state is equal to or less than a half of the combustion quantity in the intermediate combustion state, and the intermediate combustion state is assumed to be the high-efficiency combustion position.

In accordance with the boiler system according to the present invention, the intermediate combustion state is assumed to be the high-efficiency combustion position, the combustion quantity in the intermediate combustion state is assumed to be equal to or less than a half of the combustion quantity in the high combustion state, and the combustion quantity in the low combustion state is assumed to be equal to or less than a half of the combustion quantity in the intermediate combustion state, so that if the combustion quantity decreases to a value equal to or less than that in the intermediate combustion state, it can be accommodated by switching the intermediate combustion state to the low combustion state, to eliminate the necessity of start-and-stop operations, thereby inhibiting a drop in follow-up performance.

In accordance with the control program, the controller, and the boiler system according to the present invention, in combustion control of a boiler group including a plurality of boilers that are controlled at stepwise combustion positions and that have a high-efficiency combustion position where combustion occurs at a higher efficiency than the other combustion positions, it is possible to inhibit start-and-stop losses and improve desired demand follow-up performance while keeping a high combustion efficiency.

DETAILED DESCRIPTION OF THE PREFERRED EMBODIMENTS

Figure 1:
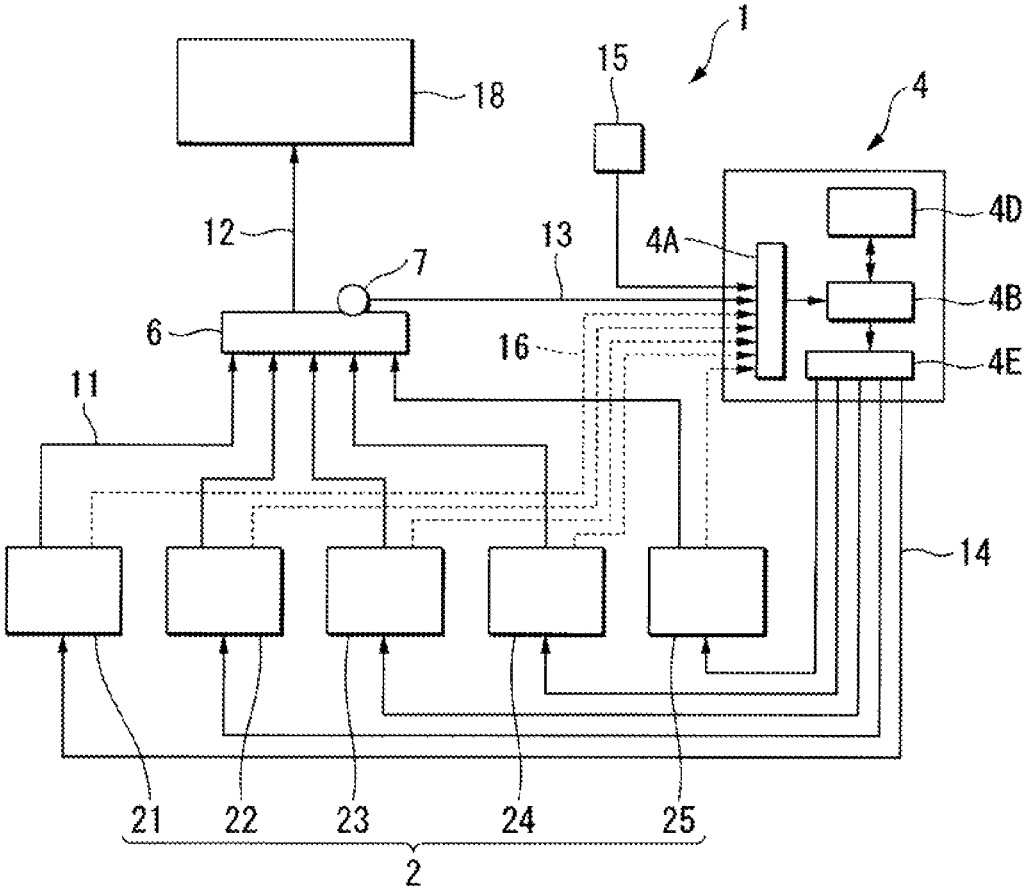
FIG. 1 is a diagram showing an outline of a boiler system according to an embodiment of the present invention.

The following will describe one embodiment of the present invention with reference to FIGS. 1 to 5C. FIG. 1 is a diagram showing the outline of a boiler system according to the present invention, in which reference numeral 1 denotes the boiler system.

The boiler system 1 includes a boiler group 2 having a plurality of boilers, a control unit 4, a steam header 6, and a pressure sensor 7 mounted on the steam header 6, in which steam generated by the boiler group 2 can be supplied to a steam using installation 18.

In the present embodiment, a desired load is the quantity of steam dissipated by the steam using installation 18, so that a pressure P of the steam in the steam header 6 to be controlled is detected with the pressure sensor 7 and, based on the pressure P, the control unit 4 conducts control on the quantity of combustion in the boiler group 2.

The boiler group 2 includes, for example, five steam boilers of a first boiler 21, a second boiler 22, a third boiler 23, a fourth boiler 24, and a fifth boiler 25.

In the present embodiment, the first boiler 21 through the fifth boiler 25 are configured to have the same combustion quantity and combustion capability at each of combustion positions, in which combustion control is possible in a combustion stopped state, a low combustion state (which corresponds to the first combustion position), an intermediate combustion state (which corresponds to the second combustion position), and a high combustion state (which corresponds to the third combustion position), the combustion quantity at the third combustion position, which is the highest combustion position, being assumed to be the combustion capability in each of the boilers.

Figure 2:
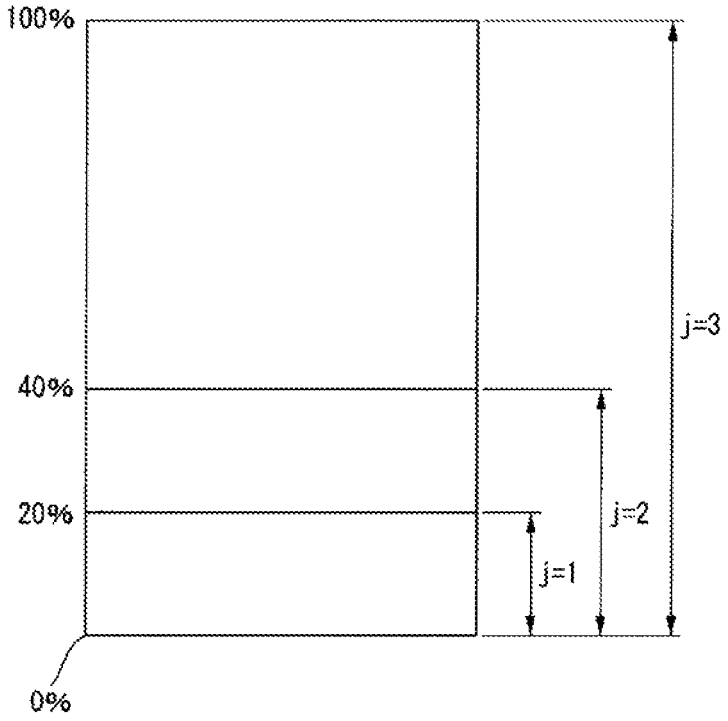
FIG. 2 is an illustrative view showing combustion bands of a boiler according to the embodiment of the present invention.

FIG. 2 is an illustrative view showing combustion quantities in the first boiler 21 through the fifth boiler 25 at the respective combustion positions, in which the vertical axis denotes combustion efficiency. It is assumed that the first boiler 21 through the fifth boiler 25 have a combustion efficiency value of 20% at the first combustion position denoted by j=1 with respect to a combustion capacity (100%) denoted by j=3, a combustion efficiency value of 40% at the second combustion position denoted by j=2 with respect to the combustion capacity, the combustion quantity at the second combustion position is equal to or less than a half of that at the third combustion position, the combustion quantity at the first combustion position is equal to or more than a half of that at the second combustion position, and the combustion efficiency is the highest at the second combustion position.

Further, the first boiler 21 through the fifth boiler 25 are each assigned a priority sequence number i that denotes a sequence number in order in which combustion control is conducted on them so that those boilers may be provided with a control signal in accordance with this priority sequence number i.

It is to be noted that the priority sequence number i in the present embodiment is assigned to the first boiler 21 through the fifth boiler 25 in this order.

Further, the boilers each have a plurality of combustion position numbers j corresponding to an increase in combustion quantity in such a manner that the combustion quantity may increase with the increasing value of the combustion position number j.

The first boiler 21 through the fifth boiler 25 in the present embodiment each have three combustion positions of the first combustion position (j=1), the second combustion position (j=2), and the third combustion position (j=3), so that the boiler group 2 has 15 virtual boilers corresponding to the combustion order sequence number J.

The control unit 4 includes an input unit 4A, an operation unit 4B, a database 4D, and an output unit 4E, in which based on a desired load input through the input unit 4A, the operation unit 4B calculates a required combustion quantity GN in the boiler group 2 and a combustion state (combustion stopped or combustion position) of each of the boilers corresponding to the required combustion quantity GN and outputs the control signal to the boilers through the output unit 4E so that combustion may be controlled.

The input unit 4A is connected to the pressure sensor 7 with a signal line 13 and configured to receive the signal of a pressure in the steam header 6 detected by the pressure sensor 7 via the signal line 13.

Further, the input unit 4A is connected to the boilers with a signal line 14 and configured to receive information of, for example, the combustion positions of the boilers via the signal line 14.

Further, the input unit 4A is connected to number-of-boilers setting means 15 and assumed to be capable of setting the number of high-efficiency combustion control subject boilers (hereinafter referred to as set number-of-boilers) K which are controlled on the basis of combustion at the high-efficiency combustion position.

The high-efficiency control subject boilers are assumed to, for example when increasing the quantity of combustion in the boiler group, make the shift to the high-efficiency combustion position in accordance with an input high-efficiency combustion shift signal; and, after the high-efficiency combustion shift signal is output, the next output control signal is assumed to be a combustion start signal for the other boilers and the combustion control signal for making the shift to a combustion position higher than the high-efficiency combustion position is assumed to be effective in condition where the high-efficiency combustion shift signal is output already to all of the high-efficiency control subject boilers.

Further, if the set number-of-boilers K is set by the number-of-boilers setting means 15, after the boilers covered by this set number-of-boilers K have all reached the high-efficiency combustion position and then, as required, the boilers not covered by this number are provided with the combustion start signal.

It is arranged so that combustion may start in the subject boilers in accordance with their priority sequence numbers i.

The operation unit 4B reads in a control program stored in a storage medium not shown (for example, read only memory (ROM)) and executes the control program to calculate the pressure P of steam in the steam header 6 based on the pressure signal from the pressure sensor 7 and acquire the combustion quantity GN required to bring the pressure P into an allowable range (between upper limit and lower limit settings of pressure of a set pressure PT by making the pressure P and the database 4D correspond to each other.

Further, combustion control is conducted to secure the required combustion quantity GN by making the combustion sequence order J for the virtual boilers of the boiler group 2 correspond to the priority sequence numbers i and the combustion positions j of the boilers 25 of the first boiler 21 through the fifth boiler 25.

It is to be noted that in the present specification, the virtual boiler corresponds to a two-position boiler assumed to be capable of generating a combustion quantity obtained by subtracting from a combustion quantity at one combustion position in a boiler group or one boiler a combustion quantity at the one-lower-numbered combustion position (boiler assumed to be capable of generating a one-stage combustion quantity by conducting ON-OFF control based on a combustion stopped state and one combustion state).

For example, if a three-position boiler capable of controlling a combustion stopped state, a low combustion state (first combustion position), and a high combustion state (second combustion position) is represented by virtual boilers, it is comprised of a first virtual boiler that generates a combustion quantity in the low combustion state and a second virtual boiler that generates a combustion quantity increased when the shift is made from the low combustion state to the high combustion state (=combustion quantity in the high combustion state−combustion quantity in the low combustion state), so that if combustion occurs in the first virtual boiler, the combustion quantity in the low combustion state is generated, while if combustion occurs in the second virtual boiler, the combustion quantity in the high combustion state of that three-position boiler, which is a total sum of the combustion quantity of the first virtual boiler and that of the second virtual boiler, is generated.

It is to be noted that the combustion order sequence number J corresponds to sequence order in which combustion occurs in the virtual boilers in which combustion is conducted by the control signal output in the J-th turn, so that the combustion quantity of the J-th virtual boiler in this order corresponds to a difference obtained by subtracting a total sum of the combustion quantities of a boiler group in a case where combustion has occurred in the boiler corresponding to the (J−1)-th virtual boiler from a total sum of the combustion quantities of the boiler group in a case where combustion has occurred in the boiler corresponding to the J-th virtual boiler in the boiler group.

Further, hence, the combustion quantity of the J-th virtual boiler in the order corresponds to a combustion quantity increased when the boiler with the priority sequence number i that corresponds to this virtual boiler is shifted to the corresponding combustion position.

The database 4D stores required combustion quantities GN in the boiler group 2 necessary to adjust the pressure P in the steam header 6 detected by the pressure sensor 7 into the allowable range of the set pressure (target pressure) PT.

Further, it stores combustion quantities Fi(j) at the combustion positions of each of the boilers in the boiler group 2. In the combustion quantity Fi(j), i denotes the priority sequence number and j denotes the combustion position of the boilers.

The output unit 4E is connected with the first boiler 21 through the fifth boiler 25 with a signal line 16 and configured to output the combustion control signal operated in the operation unit 4B to the first boiler 21 through the fifth boiler 25.

The combustion control signal contains, for example, a boiler's priority sequence number i and a combustion position j and is configured to control combustion at an identified combustion position of the boiler.

The steam header 6 is connected to the boiler group 2 (the first boiler 21 through the fifth boiler 25) via a steam pipe 11 on its upstream side and connected to the steam using installation 18 via a steam pipe 12 on its downstream side and configured to gather steam generated in the boiler group 2 and adjust differences and variations in pressure among the boilers 25 of the first boiler 21 through the fifth boiler 25 and then supply the pressure-adjusted steam to the steam using installation 18.

The steam using installation 18 is operated using steam from the steam header 6.

Figure 3:
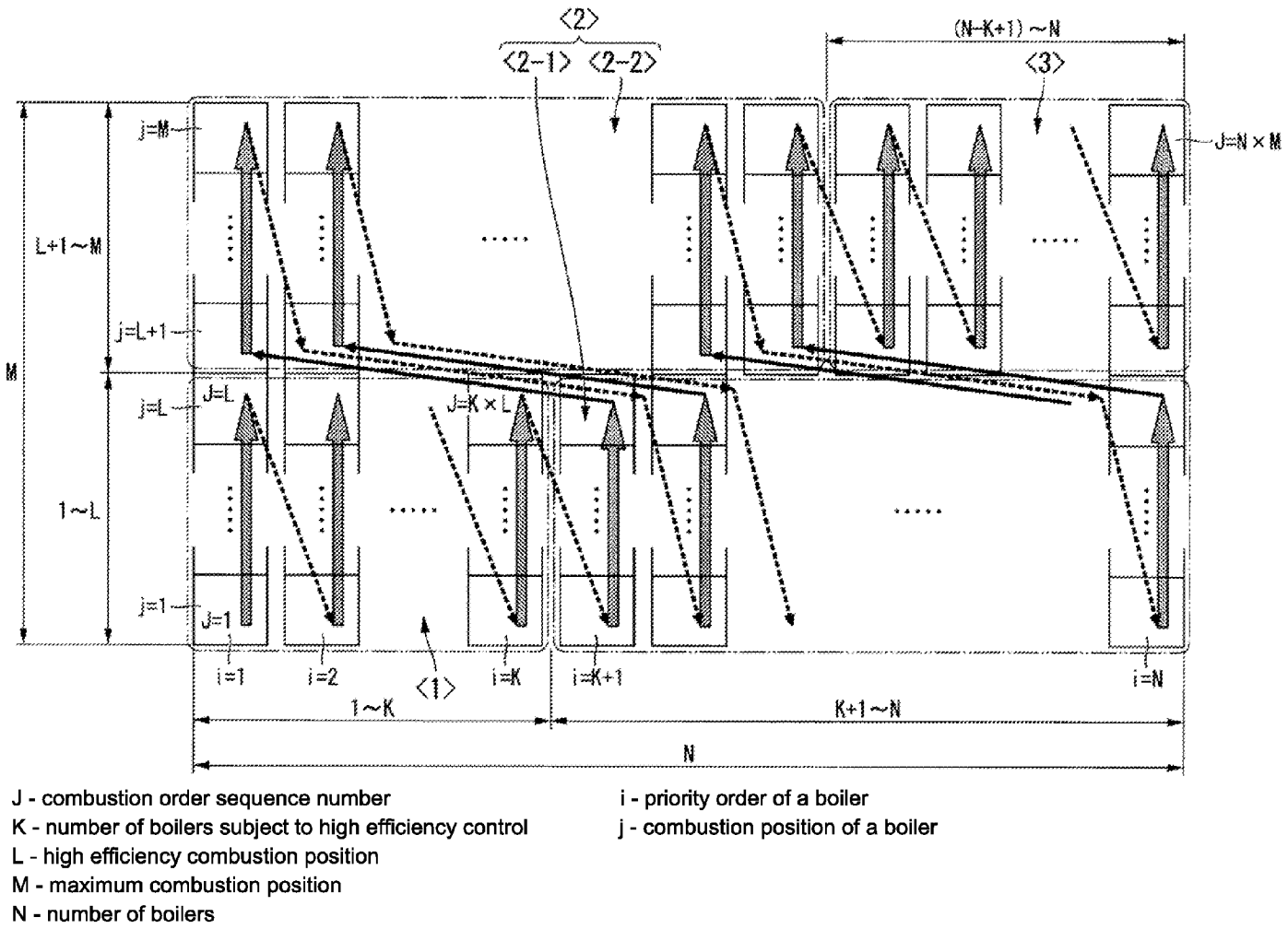
FIG. 3 is an explanatory illustrative view of one example of combustion order according to the embodiment of the present invention.
Figure 4:
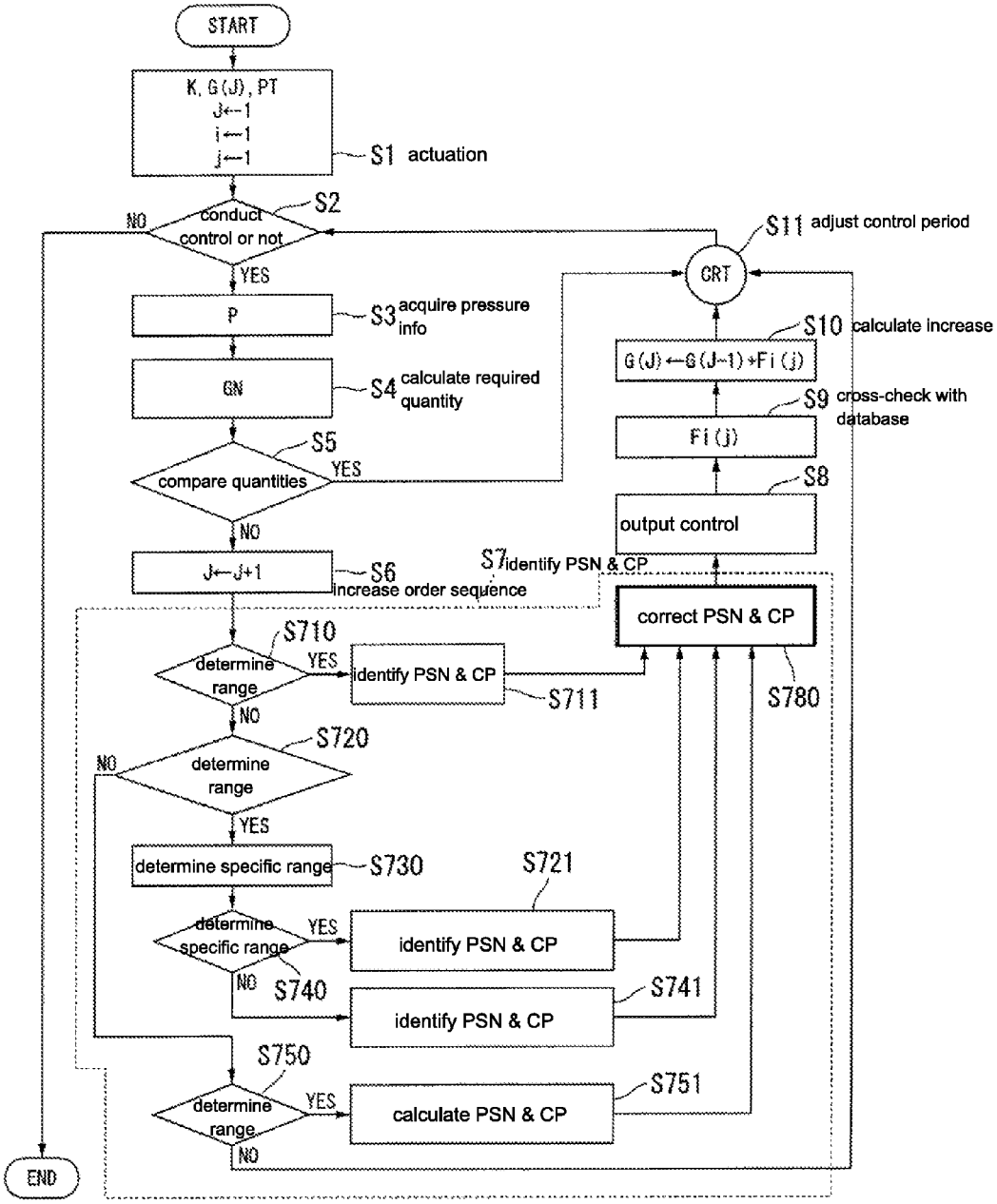
FIG. 4 is an explanatory flowchart of one example of a control program according to the embodiment of the present invention.
Figure 5:
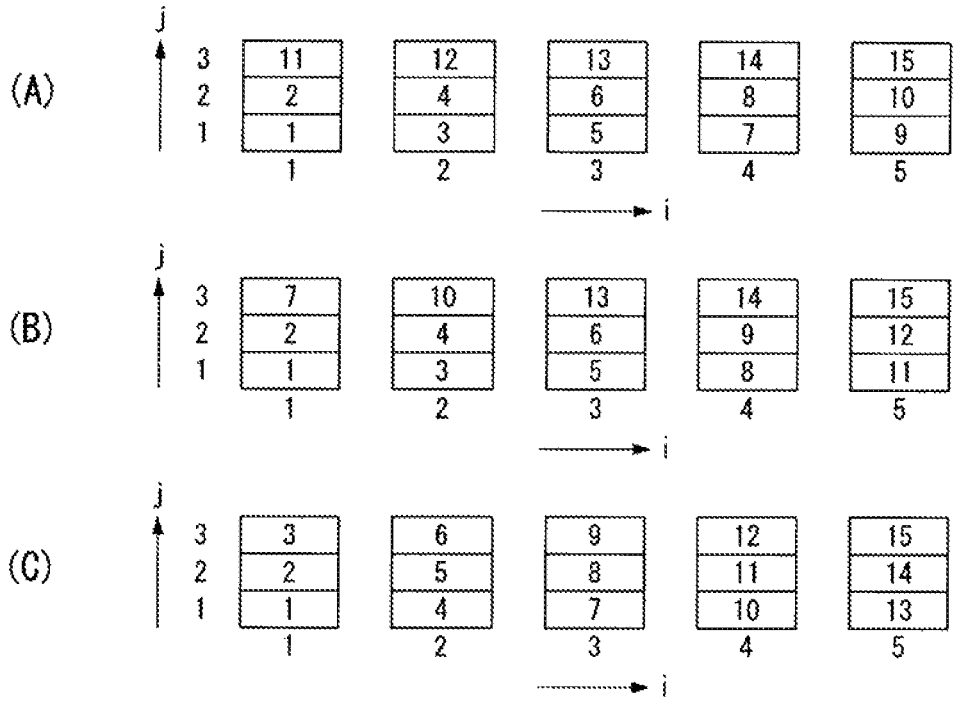
FIGS. 5A to 5C are explanatory illustrative views of operations of a boiler system in which a high-efficiency combustion position is assumed to be an intermediate combustion position according to one embodiment of the present invention, FIG. 5A of which shows a case where the set number of the boilers is five, FIG. 5B of which shows a case where the set number of the boilers is two, and FIG. 5C of which shows a case where the set number of the boilers is zero.

The following will describe combustion control on the boiler group 2 with reference to FIGS. 3 and 4.

FIG. 3 shows one example of the generalized combustion order sequence number J of the boiler group 2 according to the present invention, in which, for example, (M×N) number of virtual boilers are shown which are formed in a boiler group constituted by disposing N number of boilers each of which has combustion position 1 through combustion position M, which is assumed to be the highest combustion position.

It is to be noted that the boiler group 2 is an example in a case where it includes five boilers (N=5) in which the third combustion position (M=3) is assumed to be the highest combustion position.

FIG. 3 shows the combustion order sequence number J of the virtual boilers that constitute the boiler group in condition where it corresponds to the priority sequence number i ($1 \le i \le N$) and the combustion position j ($1 \le j \le M$; however, j=0 in the combustion stopped state) of the boilers on the assumption that the set number of the high-efficiency control subject boilers is K and the high-efficiency combustion related combustion position j=L.

It is to be noted that the case in which the boiler group's combustion order sequence number J=0 corresponds to the combustion stopped state where the priority sequence number i=1.

<1> through <3> in FIG. 3 denote ranges having different patterns of combustion order in the case of an increase in combustion quantity; combustion control on the combustion order sequence number J in each of the ranges is arranged to shift to the next range if even the highest combustion quantity in the current range is short of a necessary combustion quantity.

Further, arrows shown in FIG. 3 denote, by using the boiler's priority sequence number i and combustion position j, sequence order in which combustion shifts in a case where the combustion control signal is output in accordance with the boiler group's combustion sequence order J ($1 \leq J \leq M \times N$): a shaded bald arrow denotes an increase in combustion position number of each of the boilers, a solid-line arrow denotes the shift in combustion which is made to another boiler along with an increase in combustion position number j, and a dotted-line arrow denotes the shift in combustion which is made to another boiler along with a decrease in combustion position number j.

It is to be noted that in the boiler group's combustion stopped state, J is assumed to be 0 (J=0), in which case the priority sequence number i=1 and the combustion position j=0.

Further, the <1> through <3> ranges are denoted by a dash-and-two-dots line.

For example, combustion control in the <1> range is described with reference to FIG. 3 as follows: if combustion control is conducted on a virtual boiler with the combustion sequence number in order J=1 on initiation of combustion in a boiler group, the boiler having the priority sequence number i=1 shifts to the first combustion position (j=1) where combustion starts, to increase the quantity of combustion as required until the L-th combustion position (combustion position j=L) is reached that corresponds to the virtual boiler having the combustion order sequence number J=L. (The shift in combustion position j ($1 \leq i \leq L$) denoted by the shaded bald arrow in the boiler having the priority sequence number i=1)

Next, if the combustion quantity at the L-th combustion position (combustion position j=L) is short of a necessary combustion quantity, combustion control shifts to the virtual boiler having the combustion order sequence number (J=L+1); in this case, combustion control shifts to the first combustion position (j=1) having the priority sequence number i=2 denoted by the dotted-line arrow.

If combustion control is conducted on the virtual boiler having the combustion order sequence number J ($(L+1) \leq J \leq 2L$), the combustion quantity increases in the boiler having the priority sequence number (i=2) so that the L-th combustion position (combustion position j=L) may be reached.

This combustion control is repeated until the combustion position (j=L) of the boiler having the priority sequence number (i=K) is reached.

Likewise, combustion control in the <2> and <3> ranges in FIG. 3 also shifts in sequence order denoted by the arrow.

Further, once combustion starts, each of the boilers is configured to have its combustion quantity increased or decreased in priority to the other boilers until it returns to the combustion stopped state or reaches the combustion position j=L, where the combustion is assumed to be of a high efficiency. That is, during this lapse of time, the combustion quantity in the other boilers will not increase or decrease.

A description will be given of the combustion order sequence number J in the range denoted by <1> in FIG. 3.

In the range denoted by <1>, high-efficiency control is conducted on the boilers in a case where the set number of boilers K ($\geq 1$) is specified.

The combustion order sequence number J in a boiler group in the range denoted by <1> is such that the boiler's priority sequence number i may be equal to or less than the set number of boilers K (1-K), each of the boilers may start combustion in accordance with the priority sequence number i, and its combustion quantity, once combustion has started in it, may increase in priority to the other boilers until it returns to the combustion stopped state or reaches the high-efficiency combustion position (j=L).

Further, for example, if the combustion quantity in the boiler with the priority sequence number i at the high-efficiency combustion position (j=L) is short of a necessary combustion quantity, the combustion start signal is output to the boiler with the priority sequence number i+1 so that combustion may start in the (i+1)-th boiler in the order.

A description will be given of combustion control in the range denoted by <2> in FIG. 3.

The control signal is arranged to be output to virtual boilers in the range denoted by <2> if combustion is started in all of the boilers in the range denoted by <1> and yet the quantity of the combustion is short of a necessary combustion quantity.

In this case, combustion starts after the boiler with the priority sequence number i=(K+1) is shifted to the first combustion position (j=1).

The range denoted by <2> has the combustion order sequence number J of the boiler group ranging from $((L \times K)+1)$ to $(L \times K)+(N-K) \times M$ and includes a range denoted by <2-1> and a range denoted by <2-2>.

The range denoted by <2-1> covers the $(L \times (N-K))$ number of the virtual boilers that have the priority sequence numbers i of (K+1) through N and correspond to the combustion positions 1 to j ($1 \leq j \leq L$) respectively.

On the other hand, the range denoted by <2-2> corresponds to the (L+1)-th combustion position to the M-th combustion position ($j((L+1) \leq j \leq M)$ of the boilers having the priority sequence numbers i of 1 through (N−K) and covers the $(M-L) \times (N-K)$ number of the virtual boilers.

Combustion control in the <2> range alternate between the <2-1> range and the <2-2> range, so that if the combustion position j is present between (L+1) and M, the control signal that increases or decreases the combustion quantity is output to each of the boilers in priority to the other boilers until it returns to the L-th combustion position (j=L) or reaches the M-th combustion position (j=M).

Combustion control in the <2-1> range is conducted so that combustion may start in the boilers in accordance with the priority sequence number i ($(K+1) \leq i \leq N$) and the control signal that increments the combustion position j may be output until the combustion position j of this combustion-started boiler reaches the high-efficiency combustion position (j=L).

Then, if the combustion quantity of this boiler is short of a necessary combustion quantity even after this boilers combustion position j has reached the high-efficiency combustion position, the control signal is output to one of the boilers that is present at the high-efficiency combustion position and has the priority sequence number i ($1 \leq i \leq K$), making the shift to the <2-2> range.

Combustion control in the <2-2> range is conducted by outputting the control signal that increments the combustion position j in the <2-2> range to the boiler that has received the control signal that makes the shift to the <2-2> range.

Subsequently, if the combustion quantity is short of the necessary combustion quantity even after the combustion position j of this boiler has reached the highest efficiency combustion position (j=M), the combustion start signal is output to one of the boilers that is subject to the operations and in the combustion stopped state in the <2-1> range in accordance with the priority sequence number i.

Such combustion control is conducted until the control signal that makes the shift to the M-th combustion position is output to the boiler that has the priority sequence number i=(N−K) in the <2-2> range.

As a result, when combustion control is being conducted in the <2> range, it is possible to secure the set number (K) of the boilers present at the high-efficiency combustion position, thereby keeping high-efficiency combustion as a boiler group.

Next, a description will be given of combustion control in the range denoted by <3>.

The boilers in the range denoted by <3> have been provided with the combustion control signal that makes the shift to <3> because the virtual boilers in the range denoted by <2> had all entered the combustion state and yet their combustion quantities had been short of the necessary combusting quantity.

The virtual boilers denoted by <3> have the (M×N) number of combustion order sequence numbers J of ((K×L)+((N−K)×M)+1) and correspond to the (L+1)-th combustion position through the M-th combustion position j ((L+1)≤j≤M) of the boilers having the priority sequence numbers i of ((N−K)+1) through N, including (K×(M−L)) number of the virtual boilers that constitute a boiler group.

Combustion is conducted on the <3> range by outputting the control signal that makes the shift to a higher combustion position than the high-efficiency combustion position in accordance with the boiler's priority sequence number i (((N−K)+1)≤i≤N), so that if the combustion position j ((L+1)≤j≤M) of the boiler has reached the M-th combustion position (j=M) and yet its combustion quantity is short of the necessary combustion quantity, the control signal that shifts to the (L+1)-th combustion position (j=L+1) of the boiler that has the next priority sequence number i is output until the priority sequence number i reaches N.

It is to be noted that combustion control on any one of the boilers in the range denoted by <3> at the (L+1)-th through M-th combustion positions j is conducted in priority to the other boilers once the combustion position j has shifted to (L+1) until the combustion position j returns to the L-th combustion position (j=L) or reaches the M-th combustion position (j=M).

In the case of decreasing the combustion quantity by decrementing the combusting order sequence number J, the combustion order sequence number J as well as the boilers' priority sequence number i and combustion position $_j$ are to be shifted in order reverse to that in the case of increasing the combustion quantity; for example, the order in the case of increasing the combustion quantity is to be stored in a storage device not shown.

The following will describe the control program with reference to FIGS. 3 and 4.

FIG. 4 shows a flowchart related to one example of the control program which is executed so that the operation unit 4B may conduct combustion control on a boiler group that includes N number of boilers having the combustion position j=M and (M×N) number of combustion order sequence numbers J shown in FIG. 3.

It is to be noted that the number of boilers N, the value of M related to the highest combustion position, and the value of L related to the high-efficiency combustion position are properties specific to the boilers in the boiler group and set in an ROM etc. when installing the boiler group, for example.

In the present embodiment, the boiler group 2 is assumed to include five four-position control boilers, having the values of N=5, M=3, and L=2 related to the high-efficiency combustion position.

Next, a description will be given of operations of the boiler system 1 in the present embodiment with reference to FIGS. 3 and 4.

(1) First, the Boiler System 1 is Actuated.

In actuation, first, a set pressure PT to be held in the steam header 6 corresponding to the operations of the steam dissipating installation 18 and a set number K of high-efficiency control subject boilers to be controlled on the basis of a high-efficiency combustion position during a desired operation period (for example, week or day) are entered into the input unit 4A and set. In the present embodiment, it is assumed that an allowable range of the set pressure PT is set beforehand; however, it may be set in this step S1.

An initial value J=1 related to a virtual boiler combustion order sequence number J is read, to output the combustion control signal that corresponds to the first combustion position (j=1) of a boiler having the priority sequence number i=1 corresponding to this virtual boiler combustion order sequence number J.

In this case, a combustion quantity G (1) at the virtual boiler combustion order sequence number J=1 is set as the present combustion quantity (S1).

(2) (S2) denotes a step in which it is decided whether to conduct combustion control, as being (YES) in which combustion control is conducted or (NO) in which control is not conducted; if combustion control is to be conducted, the shift is made to the acquisition (S3) of the pressure P in the steam header 6, and if it is not to be conducted, combustion control ends.

(3) (S3) denotes a step in which the pressure P in the steam header 6 is acquired; the pressure P is acquired through calculations based on the signal from the pressure sensor 7.

(4) (S4) denotes a step in which a required combustion quantity GN is calculated which is necessary for bringing the pressure of steam into the allowable range of the set pressure PT, in which the calculated pressure P is cross-checked with the database 4D, to calculate the required combustion quantity GN necessary for bringing the pressure P into the allowable range of the set pressure PT (if the pressure P is less than the set pressure PT, the required combustion quantity is calculated on the basis of a lower limit).

(5) (S5) denotes a step in which the combustion quantity G(J) having the present combustion order sequence number J is compared to the required combustion quantity GN; as a result, if G(J)≥GN (in the case of increasing the combustion quantity), it means that the required combustion quantity GN is satisfied with a total sum of the combustion quantities of the boilers of up to the present virtual boiler (with the combustion order sequence number J).

On the other hand, if G(J)≥GN is not satisfied, it means that the total sum of the combustion quantities of the boilers of up to the present virtual boiler (with the combustion order sequence number 3) is short of the required combustion quantity GN.

It is to be noted that the present embodiment is based on the assumption that the combustion quantity G (J−1) with the combustion order sequence number (J−1) is less than the required combustion quantity GN.

It is to be noted that:

GN: Required combustion quantity necessary for bringing the pressure of steam into the allowable range of the set pressure PT; and G(J): Total sum of the combustion quantities of the virtual boilers up to the combustion order sequence number J in the boiler group.

If G(J)≥GN, the shift is made to a counter (CTR) (S11), to adjust a period up to the next time of confirmation (S2).

(6) If G(J)≥GN is not satisfied in (S5), the combustion order sequence number J is incremented by one (S6).

(7) (S7) denotes a step in which to identify the priority sequence number i and the combustion position j that correspond to the combustion order sequence number J; if the combustion order sequence number J is incremented by 1, the priority sequence number i and the combustion position j that correspond to the combustion order sequence number J are identified.

(8) (S8) denotes a step in which the control signal is output; the control signal that increases the combustion quantity is output on the basis of the identified priority sequence number i and the combustion position j.

(9) In this step, the combustion position of the boiler identified by the priority sequence number i and the combustion position j is cross-checked with the database 4D, to calculate the combustion quantity Fi(j) of this boiler (S9).

Fi(j): Combustion quantity in the boiler with the priority sequence number i which increases due to the shift from the combustion position (j−1) to the combustion position j

(10) In this step, the combustion quantity in the boiler corresponding to the combustion order sequence number (J+1) after the combustion quantity is increased is calculated on the basis of the following equation (S10):

$$G(J+1)=G(J)+Fi(j)$$

(11) The combustion control period is adjusted using the counter CTR, to wait until a predetermined lapse of time related to the period elapses, whereupon the shift is made to S2 (S11).

In the present embodiment, for example, the counter CTR is set in such a manner that after an instruction due to the output control signal is reflected in combustion, the next control signal may be output.

(12) It is decided whether to conduct combustion control (YES) or not to do it (NO), that is, to continue combustion control or end it (S2).

A description will be given of identification of the boiler's priority sequence number i and combustion position j based on the combustion order sequence number J of the boiler group in each of the <1>, <2>, and <3> ranges in (S7) in the aforementioned flowchart, with reference to FIG. 3.

First, it is identified to which one of the <1>, <2>, and <3> ranges the combustion order sequence number J of the virtual boiler belongs.

To which one of the <1>, <2>, and <3> ranges the combustion order sequence number J belongs is decided by deciding to which one of the <1>, <2>, and <3> ranges the priority sequence number i and the combustion position j of the boiler that corresponds to the combustion order sequence number J belong.

(S710), (S720), and (S750) are steps in which to decide whether the virtual boiler belongs to the <1> range, whether the virtual boiler belongs to the <2> range, and whether the virtual boiler belongs to the <3> range, respectively.

Further, (S740) is a step in which to decide which one of the <2-1> and <2-2> ranges the virtual boiler belongs to.

[Decision on Whether Combustion Order Sequence Number J Belongs to <1> Range)]

Whether the boiler belongs to the <1> range (S710) is decided by deciding, for example, whether the combustion order sequence number J≤K×L.

If it is decided in (S710) that the virtual boiler belongs to the <1> range, the shift is made to the identification (S711) of the priority sequence number i and the combustion position j of the boiler that corresponds to the combustion order sequence number J and, if it does not belongs to the <1> range, the shift is made to (S720).

[Identification of Priority Sequence Number i and Combustion Position j Corresponding to Combustion Order Sequence Number J in <1> Range]

The priority sequence number i and the combustion position j corresponding to the combustion order sequence number J belonging to the <1> range are identified as follows (S711):

$$\text{Priority sequence number } i=INT((J/L)+1)$$

$$\text{Boiler's combustion position } j=\text{mod}(J, L)$$

It is to be noted that INT( ) denotes a rounding function (in which fractional parts are truncated) and mod denotes a remainder function.

The rounding function INT( ) is used in calculation of the priority sequence number i, because after the control signal that makes the shift to the high-efficiency combustion position (j=L) or the highest combustion position (j=M) is output to the boiler having the priority sequence number i, the combustion start signal is repeatedly output to the boiler having the subsequent priority sequence number of the priority sequence number i, so that the priority sequence number i (integer) of the boiler corresponding to the combustion order sequence number J can be calculated by obtaining the quotient of a division of the combustion order sequence number J by L or M.

One (1) is added to INT(J/L) because the quotient calculated by INT( ) is rounded down to make the calculated priority sequence number i smaller by one and so this number needs to be corrected.

Further, the remainder function mod( ) is used in calculation of the boiler's combustion position j because the combustion position j can be calculated as the remainder mod (J/L) obtained by subtracting a product of the priority sequence number i and L related to the high-efficiency combustion position from the combustion order sequence number J of the virtual boiler.

[Decision on Whether Combustion Order Sequence Number J Belongs to <2> Range]

Whether the boiler belongs to the <2> range (S720) is decided by deciding, for example, whether K×L<combustion order sequence number J≤(L×K)+(N−K)×M; if K×L<combustion order sequence number J≤(L×K)+(N−K)×M, it is decided that the virtual boiler belongs to the <2> range (S720), and if the virtual boiler does not belong to the <2> range, the shift is made to S750 to decide whether the combustion order sequence number J belongs to the <3> range.

[Decision on which One of <2-1> and <2-2> Ranges the Combustion Order Sequence Number J Belongs to]

If the virtual boiler belongs to the <2> range, it is decided through (S730) and (S740) which one of the <2-1> and <2-2> ranges the virtual boiler belongs to.

(S740) is a step in which it is decided which one of the <2-1> and <2-2) ranges the combustion order sequence number J belongs to, specifically by deciding whether the combustion order sequence number J belongs to the <2-1> range by comparing the combustion position j corresponding to the combustion order sequence number J to L related to the high-efficiency combustion position.

This is because in the <2> range, the combustion position j shifts from 1 to M irrespective of the boiler's priority sequence number i, so that the combustion position j belongs to the <2-1> range if it is 1 through L, and if it is (L+1) through M, it belongs to the <2-2> range.

In (S720), the boiler's combustion position j=mod(J−(K×L), M) is calculated; if the boiler's combustion position j≤L, it belongs to the <2-1> range, and if the boiler's combustion position j>L, it belongs to the <2-2> range.

In this case, the remainder (J−(K×L)) obtained by subtracting (K×L) from the combustion order sequence number J is used, because in the decision in the <2> range, the number of the virtual boilers in the <2> range is obtained by subtracting the number of the virtual boilers in the <1> range (K×L) from the combustion order sequence number J and the remainder of its division by the combustion position M is the combustion position j corresponding to the combustion order sequence number J.

In (S740), it is decided whether the combustion position j≤L, and if the combustion position j is equal to or less than the high-efficiency position (j=L), that is, YES, it is decided that the combustion order sequence number J belongs to the <2-1> range, to make the shift to (S721), where if the combustion position j>L, it is decided that the combustion order sequence number J belongs to the <2-2> range, to make the shift to (S741).

[Identification of Priority Sequence Number i and Combustion Position j that Correspond to Combustion Order Sequence Number J in <2-1> Range]

(S721) is a step in which if the combustion order sequence number J belongs to the <2-1> range, the corresponding priority sequence number i and combustion position j are identified.

In (S721), the priority sequence number i and the combustion position j corresponding to the combustion order sequence number J in the <2-1> range are identified as:

$$\text{Priority sequence number } i = INT((J-(K\times L)/M)+(K+1))$$

$$\text{Boiler's combustion position } j = \text{mod}(J-(K\times L), M)$$

In this case, (K+1) is added in identification of the priority sequence number i, because in the case of the <2-1> range, the boiler's priority sequence number i is in the range of (K+1) through N, so that the priority sequence number i of the boiler in which combustion starts first in the <2-1> range needs to be set to (K+1).

[Identification of Priority Sequence Number i and Combustion Position j that Correspond to Combustion Order Sequence Number J in <2-2> Range]

(S741) is a step in which if the combustion order sequence number J belongs to the <2-2> range, the corresponding priority sequence number i and combustion position j are identified.

In (S741), the priority sequence number i and the combustion position j corresponding to the combustion order sequence number J in the <2-2> range are identified as:

$$\text{Priority sequence number } i = INT((J-(K\times L)/M)+1)$$

$$\text{Boiler's combustion position } j = \text{mod}(J-(K\times L), M)$$

In this case, one (1) is added in identification of the priority sequence number i because of the same reason as in the case of the aforementioned step (S711).

[Decision on Whether Combustion Order Sequence Number J Belongs to <3> Range]

Whether the boiler belongs to the <3> range (S750) is decided by deciding whether the combustion order sequence number J≤(M×N).

If J≤(M×N), it means that there are the priority sequence number i and the boiler's combustion position j that correspond to the combustion order sequence number J, so that the shift is made to (S751) to calculate the corresponding priority sequence number i and boiler's combustion position j; on the other hand, if J≤(M×N) is not satisfied, it means that there are not the corresponding priority sequence number i and boiler's combustion position j, so that the shift is made to the counter CTR.

[Identification of Priority Sequence Number i and Combustion Position j that Correspond to Combustion Order Sequence Number J in <3> Range]

The corresponding virtual boiler's priority sequence number i and combustion position j in the case where the virtual boiler's combustion order sequence number J belongs to the <3> range are calculated.

The priority sequence number i and the combustion position j that correspond to the combustion order sequence number J are identified as follows (S751):

$$\text{Priority sequence number } i = INT((J-(K\times L)+((N-K)\times M)))/(M-L)))+((N-K)+1)$$

$$\text{Boiler's combustion position } j = \text{mod}((J-((K\times L)+((N-K)\times M))), (M-L)))+L$$

Further, in (S711), (S721), (S741), and (S751), if the combustion order sequence number J is exactly divisible with the remainder of 0, the priority sequence number i and the combustion position j are corrected (S780).

According to this control program, it is possible to easily identify the priority sequence number i and the combustion position j of the boiler in a boiler group corresponding to the boiler group's combustion order sequence number J, thereby easily conducting high-efficiency combustion control on the boiler group.

Next, a description will be given of the combustion order sequence number of the boiler group 2 related to the boiler system 1.

FIGS. 5A to 5C are explanatory illustrative views of the combustion order sequence number of the boiler group 2, in which, as described above, the boiler group 2 includes five boilers having M=3 related to the highest combustion position, with L=2 related to the high-efficiency combustion position.

In FIGS. 5A to 5C, square-shaped frames each denote each of the boilers in the boiler group 2, each boiler being assigned a numeral denoting its combustion order sequence number J. Further, the horizontal axis denotes the priority sequence number i and the combustion position j of each of the boilers in the boiler group 2.

FIG. 5A shows the combustion order sequence number of the boiler group 2 in the case of the set number of boilers K=5.

In this case, since the set number of boilers K=5, after combustion starts in the first boiler 21 to provide the first combustion position, the combustion position shifts to the second combustion position (combustion position j=2), and if the combustion quantity is insufficient even at the second combustion position, combustion starts in the second boiler 22. Combustion control of this kind is repeated until the second combustion position of the fifth boiler 25 (priority sequence number i=5) is reached. Further, the combustion quantity is short of a required combustion quantity at the second combustion position of the fifth boiler 25, the first boiler 21 is shifted to the third combustion position to increase its combustion quantity, and if this combustion quantity is insufficient yet, the second boiler 22 is shifted to the third combustion position, and ongoingly, as required, the third boiler 23 through the fifth boiler 25 are shifted to the third combustion position to increase the combustion quantities.

As a result, in the case of increasing the combustion quantities of the boiler group 2, combustion occurs in all of the boilers at the high-efficiency combustion position, so that they can be operated at high thermal energy efficiency.

Next, FIG. 5B shows the combustion order sequence number of the boiler group 2 the case of the set number of boilers K=2.

The combustion order sequence number J of the virtual boilers in the boiler group 2 and the boiler's priority sequence number i and the combustion position j that correspond to the combustion order sequence number J are such as those shown in the figure.

As a result, for example, if a required combustion quantity in a desired operation period is approximate to the high-efficiency combustion quantity in the two boilers, the set number of boilers K can be set to two (K=2) to thereby operate the boiler group 2 at high thermal energy efficiency.

FIG. 5C shows the combustion order sequence number of the boiler group 2 in the case of the set number of boilers K=0.

The combustion order sequence number J of the virtual boilers in the boiler group 2 and the boiler's priority sequence number i and the combustion position j that correspond to the combustion order sequence number J are such as those shown in the figure.

In this case, the set number of boilers K is set to 0 (K=0) and, therefore, there are no high-efficiency combustion control subject boilers, so that the combustion control signal is output in accordance with the priority sequence number i of the first boiler 21 through the fifth boiler 25 in this order.

Further, the boiler provided with the control signal that starts combustion has an increasing combustion quantity until it reaches the second combustion position, and if the combustion quantity at the second combustion position is yet insufficient, the combustion start signal is output to the boiler having the next priority sequence number.

In accordance with the boiler system 1 according to this embodiment, the intermediate combustion state is assumed to be the high-efficiency combustion position, the combustion quantity in the intermediate combustion state is assumed to be equal to or less than a half of the combustion quantity in the high combustion state, and the combustion quantity in the low combustion state is assumed to be equal to or less than a half of the combustion quantity in the intermediate combustion state, so that if the combustion quantity decreases to a value equal to or less than that in the intermediate combustion state, it can be accommodated by switching the intermediate combustion state to the low combustion state, to eliminate the necessity of start-and-stop operations, thereby inhibiting a drop in follow-up performance. This results in improvements in boiler group's combustion efficiency and desired load follow-up performance.

Further, in the boiler system 1, once combustion starts in any one of the boilers, combustion never starts in the other boilers until that boiler returns to the combustion stopped state or reaches the high-efficiency combustion position, so that the boiler group 2 itself is inhibited from performing the start-and-stop operation, to enable improving the follow-up performance.

It is to be noted that the present invention is not limited the aforementioned embodiment and, accordingly, any and all modifications etc. should be considered to be within the scope of the present invention without departing the gist of the present invention.

For example, although the embodiment has been described with reference to the case of constituting the boiler group 2 in the boiler system 1 of five boilers, an arbitrary number of two or larger of boilers may constitute the boiler group 2.

Further, although the embodiment has been described with reference to the case of performing combustion in the boilers in the boiler group 2 in accordance with the priority sequence number i and the combustion position j, actual combustion may be performed in order different from that of the control signal by, for example, a time lag or a plurality of combustion operations may be performed simultaneously.

Further, although the embodiment has been described with reference to the case of arranging the boiler's priority sequence numbers i and combustion positions j in the case of decreasing the combustion quantity of the boiler group 2 in a manner opposite to the case of increasing the combustion quantity, the order of the boiler's priority sequence numbers and combustion positions in the case of decreasing the combustion quantity may be set arbitrarily.

Further, although the embodiment has been described with reference to the case of conducting combustion control on all of the five boilers 21 through 25 of the boiler group 2, if, for example, the boiler group 2 is stopped in project owing to a fault, repair, etc., combustion control may be conducted on some of the boilers that can be operated.

Further, although one example of the flowchart illustrating the outlined configuration of the program according to the present invention has been shown in FIG. 4, of course, any other methods (algorithm, operations, etc.) than the flowchart shown in FIG. 4 may be used to configure the program according to the present invention.

Although the embodiment has been described with reference to the case of calculating the combustion quantity in the boiler group 2 in condition where it is correlated with the database 4D, the combustion quantity corresponding to a desired load may be calculated through operations.

Although the embodiment has been described with reference to the case of calculating the priority sequence number i and the combustion position j of the boiler that correspond to the combustion order sequence number J of the boiler group 2 along the flow of the program, they may be identified by, for example, storing a matrix etc. arranged through calculations beforehand in the database 4D so that they could be correlated with this matrix etc.

Further, although the embodiment has been described with reference to the case of setting the same combustion capacity evenly to the boilers of the boiler group 2, the combustion capacities and the combustion quantities at the combustion positions may be set differently to some or all of the boilers of the boiler group 2.

Further, although the embodiment has been described with reference to the case of assigning the priority sequence number i in starting of combustion to the first boiler 21 through the fifth boiler 25 in this order, such a priority sequence number i may be changed arbitrarily: the setting of the priority sequence number i may be changed, for example, by setting the lowest priority sequence number to the boiler that is provided with the control signal for providing the combustion stopped state or making the shift to the high-efficiency combustion position or the highest combustion position in condition where the boilers are controlled in combustion based on a predetermined temporary priority sequence number or that has reached those combustion positions.

Further, although the embodiment has been described with reference to the case of a steam boiler in which the pressure of steam is to be controlled by detecting the steam pressure P with the pressure sensor 7 mounted on the steam header 6, other parameters, for example, a steam quantity or a steam usage quantity in the steam utilizing installation 18 may be controlled or a desired load may be detected using any means other than the pressure sensor 7 mounted on the steam header 6 if the pressure P is to be controlled.

Further, in the boilers of the boiler group 2, the steam boiler may be replaced with a hot water boiler in which a temperature difference of the hot water is to be controlled.

Further, although the embodiment has been described with reference to the case of using an ROM as the recording medium configured to store the program, any other medium other than the ROM can be used such as an EP-ROM, hard disk, flexible disk, optical disk, magneto-optical disk, CD-ROM, a CD-R, magnetic tape, or nonvolatile memory card. Further, when the read program is executed by the operation unit, not only the actions of the embodiment are realized but also the operating system (OS) working in the operation unit performs part or all of actual processing based on instructions of the program, which processing may realize the actions of this embodiment in some cases. Moreover, such a case may be possible in which the program read from the storage medium is written into a memory equipped to a function enhancement board inserted to the operation unit or a function enhancement unit connected to the operation unit so that subsequently, based on the instructions of this program, the CPU etc. equipped to this function enhancement board or function enhancement unit may perform part or all of the actual processing, which processing may realize the actions of this embodiment.

What is claimed is:

1. A non-transitory storage medium storing a control program configured to control a combustion status of a plurality of boilers, each of which has at least a first combustion according to a first combustion position and a second combustion according to a second combustion position that has higher combustion efficiency than the first combustion position, the storage medium including instructions configured to cause a controller of a boiler system to implement a method comprising:

allowing, via a number-of-boilers setting device of the boiler system, to enter a desired number of boilers which are to undergo the second combustion according to the second combustion position among the plurality of boilers;

setting the desired number of boilers entered in the allowing, such that follow-up performance is improved while keeping high combustion efficiency, sending a signal indicating a shift to the second combustion to the desired number of boilers thus having been set in the setting when a quantity of combustion of the plurality of boilers is increased;

sending a signal indicating a start of combustion to one of boilers when the boilers exist, which have not been set in the setting as the boilers of the second combustion, on condition that the signal indicating a shift to the second combustion has been sent to every one of the boilers which have been set in the setting as the boilers of the second combustion; and sending a signal indicating a shift to a third combustion according to a third combustion position which has a higher combustion position than the second combustion position to one of the boilers of the second combustion when no boilers exist, which have not been set in the setting as the boilers of the second combustion, on condition that the signal indicating a shift to the second combustion has been sent to every one of the boilers which have been set in the setting as the boilers of the second combustion.

2. The non-transitory storage medium storing the control program of claim 1, further comprising:

sending a signal to the one of the boilers, the signal indicating an increase in a quantity of combustion until the one of the boilers starts the second combustion, when the signal indicating the start of combustion has been sent to the one of the boilers which have not been set as the boilers of the second combustion; and sending the signal indicating a shift to the third combustion to one of the boilers of the second combustion, on condition that the signal indicating a shift to the second combustion has been sent to the one of the boilers which have not been set as the boilers of the second combustion.

3. The non-transitory storage medium storing the control program of claim 2, further comprising:

sending a signal indicating a start of combustion to another one of the boilers which have not been set as the boilers of the second combustion, on condition that the signal indicating a shift to the third combustion has been sent to the one of the boilers, when a quantity of combustion of the plurality of boilers is increased.

4. The non-transitory storage medium storing the control program of claim 1, wherein the controller includes the storage medium storing the control program.

5. A boiler system comprising the controller of claim 4.

6. A boiler system comprising:

a plurality of boilers, each of which has at least a first combustion according to a first combustion position and a second combustion according to a second combustion position that has higher combustion efficiency than the first combustion position;

a controller configured to control a combustion status of the plurality of boilers; and a number-of-boilers setting device configured to be connected communicably with the controller and to allow entering a desired number of boilers which are to undergo the second combustion according to the second combustion position among the plurality of boilers;

wherein the controller configured to execute actions including:

sending a signal indicating a shift to the second combustion to the desired number of boilers thus having been entered via the number-of-boilers setting device when a quantity of combustion of the plurality of boilers is increased;

sending a signal indicating a start of combustion to one of boilers when the boilers exist, which have not been entered via the number-of-boilers setting device as the boilers of the second combustion, on condition that the signal indicating a shift to the second combustion has been sent to every one of the boilers which have been entered via the number-of-boilers setting device as the boilers of the second combustion; and sending a signal indicating a shift to a third combustion according to a third combustion position which has a higher combustion position than the second combustion position to one of the boilers of the second combustion when no boilers exist, which have not been entered via the number-of-boilers setting device as the boilers of the second combustion, on condition that the signal indicating a shift to the second combustion has been sent to every one of the boilers which have been entered via the number-of-boilers setting device as the boilers of the second combustion, wherein the controller is configured to set the desired number of boilers, such that follow-up performance is improved while keeping high combustion efficiency.

7. The boiler system of claim 6, wherein the actions further include:

sending a signal to the one of the boilers, the signal indicating an increase in a quantity of combustion until the one of the boilers starts the second combustion, when the signal indicating the start of combustion has been sent to the one of the boilers which have not been set as the boilers of the second combustion; and sending the signal indicating a shift to the third combustion to one of the boilers of the second combustion, on condition that the signal indicating a shift to the second combustion has been sent to the one of the boilers which have not been set as the boilers of the second combustion.

8. The boiler system of claim 7, wherein in the case of increasing the quantity of combustion in the plurality of boilers, the controller causes one of the boilers to start combustion, which have not been set as the boilers of the second combustion and have not started combustion, each time the quantity of combustion in the boilers of the second combustion that have shifted to the third combustion higher than the second combustion increases up to a highest combustion position where the quantity of combustion is maximized.

9. The boiler system of claim 6, wherein the boilers are four-position control boilers in which combustion is controllable in a low combustion state, an intermediate combustion state, and a high combustion state; and wherein the quantity of combustion in the intermediate combustion state is equal to or less than a half of the quantity of combustion in the high combustion state, the quantity of combustion in the low combustion state is equal to or less than a half of the quantity of combustion in the intermediate combustion state, and the intermediate combustion state corresponds to the second combustion position.

* * * * *